United States Patent [19]

Michelotti

[11] 4,262,434

[45] Apr. 21, 1981

[54] RUNNING SHOE WITH REPLACEABLE TREAD ELEMENTS

[76] Inventor: Paul E. Michelotti, 59 Bob Hill Rd., Ridgefield, Conn. 06877

[21] Appl. No.: 61,631

[22] Filed: Jul. 30, 1979

[51] Int. Cl.[3] ..... A47C 15/00; A43B 5/00

[52] U.S. Cl. ..... 36/67 D; 36/129

[58] Field of Search ..... 36/67 R, 67 D, 134, 36/59 R, 129

[56] References Cited

U.S. PATENT DOCUMENTS

| | | | |
|---|---|---|---|
| 2,607,134 | 8/1952 | Langer | 36/67 D |
| 2,745,197 | 5/1956 | Holt | 36/67 D |
| 3,566,489 | 3/1971 | Morley | 36/67 D |
| 3,775,874 | 12/1973 | Bonneville | 36/67 D |
| 3,928,881 | 12/1975 | Bente | 36/67 D |

*Primary Examiner*—Patrick D. Lawson

*Attorney, Agent, or Firm*—Parmelee, Johnson, Bollinger & Bramblett

[57] ABSTRACT

A sole for running shoes which utilizes detachable tread elements. The main sole contains perforations consistent with the pattern and number of tread elements. Integral with the elements are shafts which fit into the perforations. This arrangement allows the user to replace worn treads and this greatly extends the usable life of the shoe.

1 Claim, 4 Drawing Figures

RUNNING SHOE WITH REPLACEABLE TREAD ELEMENTS

BACKGROUND OF THE INVENTION

The modern running shoe is often constructed with pronounced tread designs which are intended to cushion the impact of the foot upon the ground. However, with frequent use, the treads are quickly worn away and the cushion effect is destroyed.

Replacement soles for running shoes are virtually non-existent, and the average shoe repair facility would find it extremely difficult to replace such soles even if they were available. The soles are usually bonded to the shoe with polymers which are not easily separated, and which, in general, are not available to the average shoe repairman. As a result, when the tread wears out, the shoe is usually discarded. It is not unusual for a long-distance runner to wear out a pair of running shoes in one month's time.

While interchangeable spikes and lugs are known for such applications as golf and football shoes, they would not be suitable for running shoes because they require metal. This would undesirably increase the weight of the shoe.

It is, therefore, a primary object of the present invention to provide a sole for running shoes in which worn treads can be quickly and easily replaced by the user of the shoe. Another object is to provide such a sole which does not require the use of metal.

Other objects, features, and advantages will become apparent from the following description and appended claims.

SUMMARY OF THE INVENTION

An improved running shoe of the type having a flexible sole with a tread pattern formed by a plurality of resilient tread elements extending outwardly therefrom. The improvement resides in the feature of at least some of the elements being selectively removable from and engageable with the sole. Elastomeric means are provided for securing each of the elements to the sole when so engaged.

DESCRIPTION OF THE PREFERRED EMBODIMENT

Figure 1:
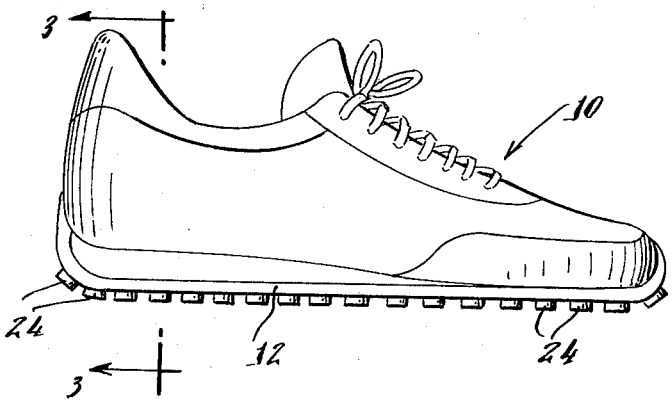
FIG. 1 is a side view of a running shoe incorporating the present invention.
Figure 2:
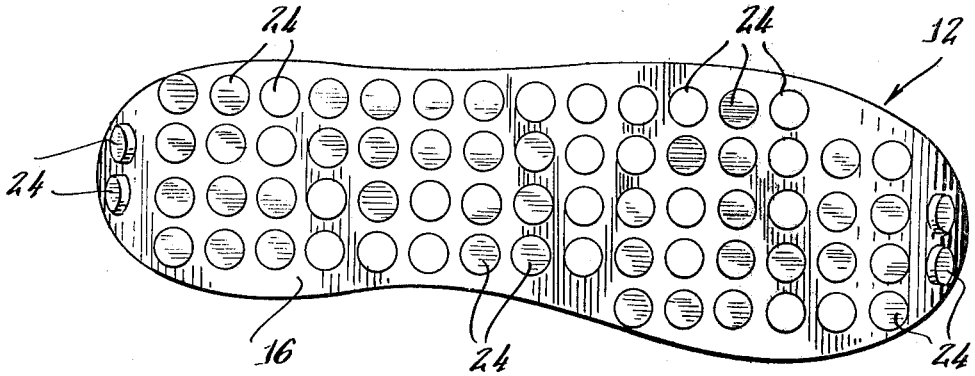
FIG. 2 is a bottom view illustrating the sole of the shoe of FIG. 1.
Figure 3:
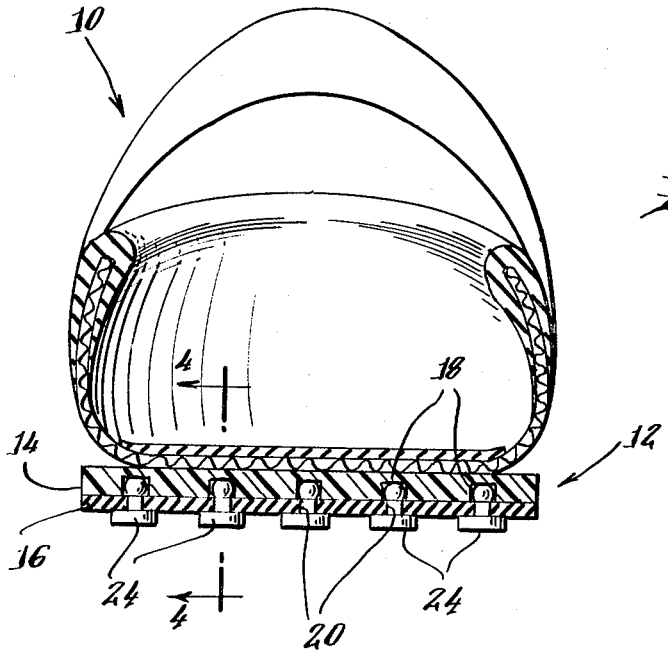
FIG. 3 is a cross-section taken substantially along the line 3—3 of FIG. 1.
Figure 4:
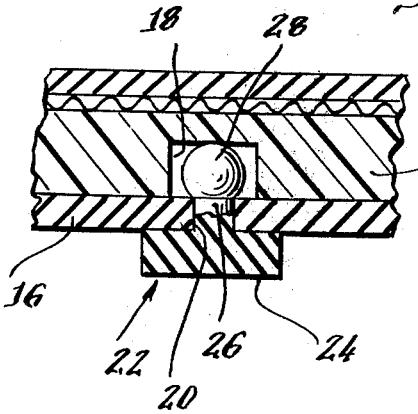
FIG. 4 is an enlarged cross-section taken substantially along the line 4—4 of FIG. 3.

There is illustrated in FIG. 1 a running shoe 10 having a sole 12. In the illustrated embodiment, as will be apparent from FIGS. 3 and 4, the sole 12 is laminated and includes a relatively thick body 14 and a thinner surface layer 16. Extending into sole body 14 are a plurality of apertures 18. Similarly, the surface layer 16 of the sole defines a plurality of openings 20 which, in the assembled lamination, centrally overlie the respective apertures 18.

The tread of sole 12 is formed by a plurality of resilient tread elements 22 which may be of rubber or other elastomeric. Each of the elements 22 includes a ground engaging tread disc 24, a shaft 26 extending from one side thereof, and an enlarged knob 28 or protuberance, at the end of the shaft. The surface of the knob may be knurled or otherwise shaped to increase friction and prevent its dislodgement while running. As will be seen from FIG. 4, a tread element is retained on the sole by pushing the elastomeric shaft 26 and knob 28 through the opening 20 in surface layer 16 and permitting the knob 28 to expand within the aperture 18 of the sole body 14. In this manner, the tread elements are securely retained on the sole.

When the tread elements have worn, they may readily be removed by pliers or other suitable tool, such as a nail removing claw, and replaced by new tread elements.

It is believed that the many advantages of this invention will now be apparent to those skilled in the art. There has been provided a running shoe with replaceable resilient tread elements which are held in place by lightweight, non-metallic means. In this manner, the life of a running shoe can be greatly extended. It will also be apparent that a number of variations and modifications may be made in this invention without departing from its spirit and scope. Accordingly, the foregoing description is to be construed as illustrative only, rather than limiting. This invention is limited only by the scope of the following claims.

What is claimed is:

1. In a running shoe of the type having a flexible elastomeric sole with a tread pattern thereon formed by a plurality of elastomeric tread elements extending outwardly therefrom, the improvement which comprises:

said sole having a plurality of apertures therein including an enlarged diameter portion spaced inwardly from the surface of said sole;

at least some of said elements being selectively removable from, and engageable with, said apertures in said sole; and said elastomeric tread elements each having a ground engaging tread disc on a shaft which is insertable into one of said apertures in said sole, and a locking protuberance on said shaft opposite said disc engageable within the enlarged diameter portion of said aperture whereby said tread disc is flush against said sole when said tread element is mounted in an aperture of said sole.

* * * * *